US008943942B1

(12) United States Patent
Bartolucci

(10) Patent No.: US 8,943,942 B1
(45) Date of Patent: Feb. 3, 2015

(54) ANTI-FRATRICIDE RESPONSIVE ORDNANCE SYSTEM

(71) Applicant: Stephen F. Bartolucci, Mechanicville, NY (US)

(72) Inventor: Stephen F. Bartolucci, Mechanicville, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 60 days.

(21) Appl. No.: 13/847,587

(22) Filed: Mar. 20, 2013

(51) Int. Cl.

| | |
|---|---|
| ***F41A 17/08*** | (2006.01) |
| ***F42C 13/04*** | (2006.01) |
| ***F42C 13/02*** | (2006.01) |
| ***F42C 15/44*** | (2006.01) |

(52) U.S. Cl.
CPC ..... *F41A 17/08* (2013.01); *F42C 13/04* (2013.01); *F42C 13/026* (2013.01); *F42C 15/44* (2013.01); *F42C 13/047* (2013.01)
USPC ..... 89/1.11; 102/213; 102/214

(58) Field of Classification Search
CPC ..... F41A 17/08
See application file for complete search history.

(56) References Cited

U.S. PATENT DOCUMENTS

| | | | | |
|---|---|---|---|---|
| 3,298,023 | A | 1/1967 | Prestwood | |
| 4,168,663 | A * | 9/1979 | Kohler | 102/214 |
| 4,642,648 | A | 2/1987 | Hulland et al. | |
| 5,001,488 | A | 3/1991 | Jogue | |
| 5,327,145 | A | 7/1994 | Jelinek | |
| 6,025,795 | A | 2/2000 | Hulderman et al. | |
| 7,295,296 | B1 | 11/2007 | Galli | |
| 8,125,371 | B1 * | 2/2012 | Daniel | 342/45 |
| 8,176,834 | B1 | 5/2012 | Arevalo et al. | |
| 2006/0042494 | A1 | 3/2006 | Lucas et al. | |
| 2010/0289691 | A1 | 11/2010 | Ivtsenkov et al. | |

FOREIGN PATENT DOCUMENTS

JP 402050100 * 2/1990

OTHER PUBLICATIONS

Wikipedia, "Identification friend or foe," available online at: http://en.wikipedia.org/wiki/Identification_friend_or_foe, Feb. 1, 2013.

* cited by examiner

*Primary Examiner* — Stephen M Johnson
(74) *Attorney, Agent, or Firm* — Henry S. Goldfine

(57) ABSTRACT

An anti-fratricide responsive ordnance system that uses the power of a friendly radio frequency signal to detect and identify a friendly force. Upon identification, an electronic safe and arm device disarms the munition when it enters a kill radius of the friendly force emitting the friendly radio signal.

11 Claims, 8 Drawing Sheets

ANTI-FRATRICIDE RESPONSIVE ORDNANCE SYSTEM

GOVERNMENTAL INTEREST

The invention described herein may be manufactured and used by, or for the Government of the United States for governmental purposes without the payment of any royalties thereon.

FIELD OF THE INVENTION

The present invention relates to identification, friend or foe (IFF) systems, and in particular to an anti-fratricide responsive ordnance system that uses the power of a friendly radio frequency signal to detect and identify a friendly force. Upon identification, an electronic safe and arm device disarms the munition when it enters a kill radius of the friendly force emitting the friendly radio signal.

BACKGROUND OF THE INVENTION

Fratricide, or the inadvertent killing of friendly forces by other friendly forces, has been a persistent concern, probably since the inception of warfare. Even with the advancement of smart weapons, fratricide by indirect fire projectiles after the munition is fired, has not been eliminated. A conventional solution to fratricide has been the use of an identification, friend or foe (IFF) system.

In general, an IFF system is an identification system that enables a military interrogation system to identify a friendly force and to determine whether a potential target should be engaged. Although the IFF system has proven to be helpful, there still remains a need for an anti-fratricide responsive ordnance system that disarms the munition, particularly during flight, after it is has been fired.

Numerous IFF systems, reconnaissance systems, and safety and arming devices have been proposed, among which are those described in the following publications: Prestwood, U.S. Pat. No. 3,298,023; Hulland, et al., U.S. Pat. No. 4,642,648; Joguet, U.S. Pat. No. 5,001,488; Jelinek, U.S. Pat. No. 5,327,145; Hulderman, et al., U.S. Pat. No. 6,025,795; Galli, U.S. Pat. No. 7,295,296; Arevalo, et al., U.S. Pat. No. 8,176,834; Lucas, et al., (U.S. Patent Application No. 2006/0042494); and Ivtsenkov, et al., U.S. Patent Application No. 2010/0289691.

However, many of these systems propose pre-fire IFF, line-of-sight, interrogation-based approaches to identify whether a potential target is a friend or a foe.

Therefore, a need arises for a post-fire IFF, non-line-of-sight, non-interrogation-based system that disarms an approaching munition when it enters a kill radius of the friendly force, and which is capable of re-arming the munition upon exiting the kill radius. The need for such an anti-fratricide system has heretofore remained unsatisfied.

SUMMARY OF THE INVENTION

The present invention addresses the foregoing concerns and presents a new post-fire IFF, non-line-of-sight, non-interrogation-based anti-fratricide responsive ordnance system (also referred to herein as "the system," "the present system," or "the present anti-fratricide system") that disarms an approaching munition when it enters a kill radius of the friendly force, and which is capable of re-arming the munition upon exiting the kill radius.

To this end, the present anti-fratricide system provides a last line of defense for friendly forces once a munition (projectile or ordnance) has been launched and targeted by other friendly forces.

The present system includes a field element that is in the possession of the friendly force under the fratricide attack, whether it is a ground combat vehicle, a single soldier, or a group of soldiers. This field element performs the function of transmitting a weak RF signal or another electromagnetic (EM) signal (which may be encrypted) that is referred to herein as the friendly signal or IFF signal.

Upon reception of the IFF signal by a receiver located on the munition, the receiver recognizes and identifies the IFF signal as a friendly IFF signal and further determines the power level of the IFF signal. Upon determining that the power level of the IFF signal has reached a predetermined strong (or high) level threshold, the receiver emits a command signal to a safe and disarm.

In response to the command signal, a safe and disarm mechanism disarms the munition so that the munition does not explode upon impact. The munition at that point is essentially, a dud, or a weak kinetic energy weapon. Elimination of the high explosive will likely save the lives of the friendly forces.

The weak RF signal from element 1 is set to a specific distance based on the power used, so that it is still set to explode if it is a safe distance from the friendly forces, such as the kill or casualty radius of the munition.

If the receiver determines that the power level of the IFF signal has not reached a weak (or low) level threshold, it does not interfere with the arming or disarming of the munition. If, on the other hand, the receiver determines that the power level of the IFF signal has reached the weak level threshold but has not yet reached the strong level threshold, it establishes a line of communication with the fuse receiver of the munition, in readiness of the munition approach toward the kill zone, and to the issuance of the disarm signal.

If, at any stage of the flight trajectory of the munition, it is determined that the munition has exited the kill zone after it has previously entered it, then the field element retransmits a cancellation command signal to the receiver onboard the munition. The cancellation command signal causes the fuze element to re-arm the munition so that is detonates upon impact or as initially programmed.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1:
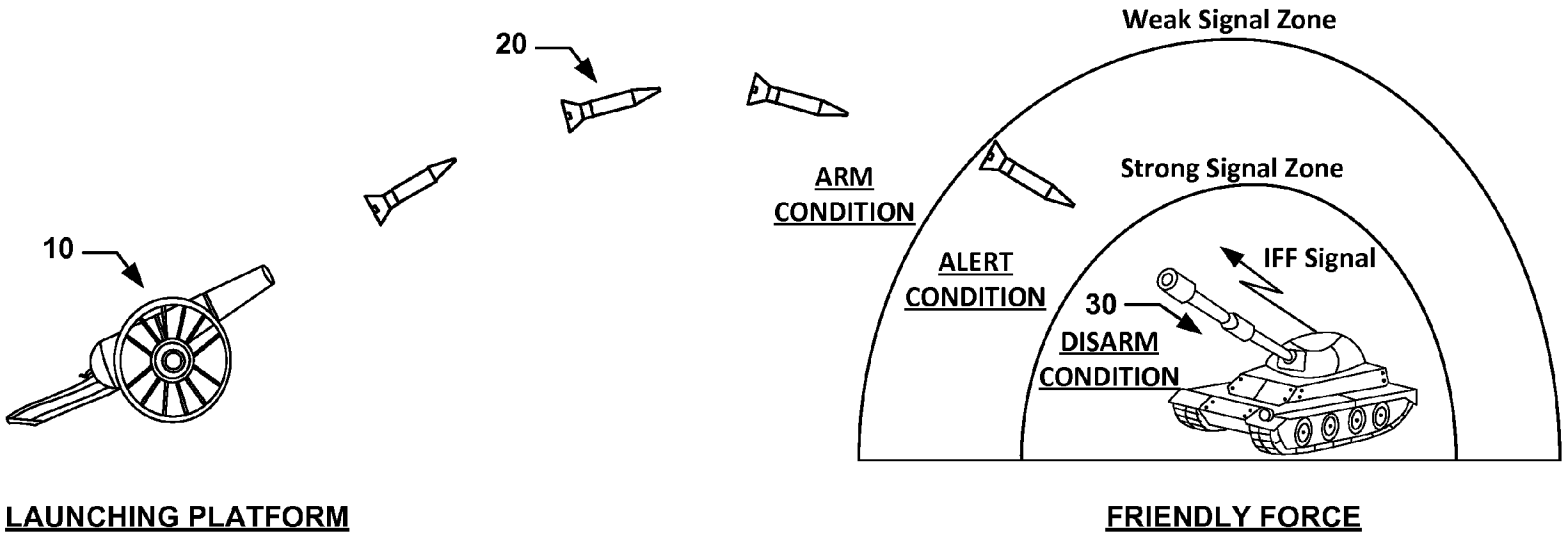
FIG. 1 is an exemplary fratricide scenario that is addressed by an anti-fratricide responsive ordnance system of the present invention, showing an ordnance entering a strong signal zone established by the present anti-fratricide system.

With reference to FIG. 1, it illustrates a first exemplary fratricide scenario that is addressed by an anti-fratricide responsive ordnance system 100 (FIG. 2) of the present invention. According to this scenario, a launching platform 10, such as a cannon, mortar, or another launching system, fires an ordnance (or projectile) 20 shown in flight toward a friendly force 30. The friendly force 30 can be for example, and without limitation, a ground combat vehicle, a single soldier, or a group of soldiers.

The friendly force uses a battlefield radio frequency (RF) signal or another IFF signal that identifies the friendly force 30. In a preferred embodiment of the present invention, an IFF transmitter 210 (FIG. 2) that transmits such IFF signal is known and available, and therefore, the present anti-fratricide system 100 does not necessarily require substantial hardware, software, or modification to be made to the existing transmission equipment.

The transmitted IFF signal is naturally attenuated as it is progressively distanced from the friendly source 30. The present anti-fratricide system 100 uses this attenuation property of the IFF signal to establish two zones for estimating the distance of the ordnance 20 from the friendly force 30.

The first zone is referred to as the strong signal zone within which the IFF signal is still relatively strong and has not been attenuated below a strong signal threshold. The strong signal zone defines a kill radius of the friendly force 30, whereby the ordnance 20 poses imminent deadly danger to the friendly force 30, and is in the terminal stage of its ballistic path. Consequently, the present anti-fratricide system 100 disarms the ordnance 20 as long as it is within the strong signal zone.

The second zone is referred to as the weak signal zone within which the IFF signal is relatively weak, has been attenuated below the strong signal threshold of the strong signal zone, but still has not been attenuated below a weak signal threshold of the weak signal zone. The entry of the ordnance 20 into the weak signal zone indicates a potential danger to the friendly force 30, and the present anti-fratricide system 100 enters into an alert stage, but does not necessarily disarms the ordnance 20.

As long as the ordnance 20 does not enter the strong signal zone, the present anti-fratricide system 100 does not disarm the ordnance 20.

Figure 2:
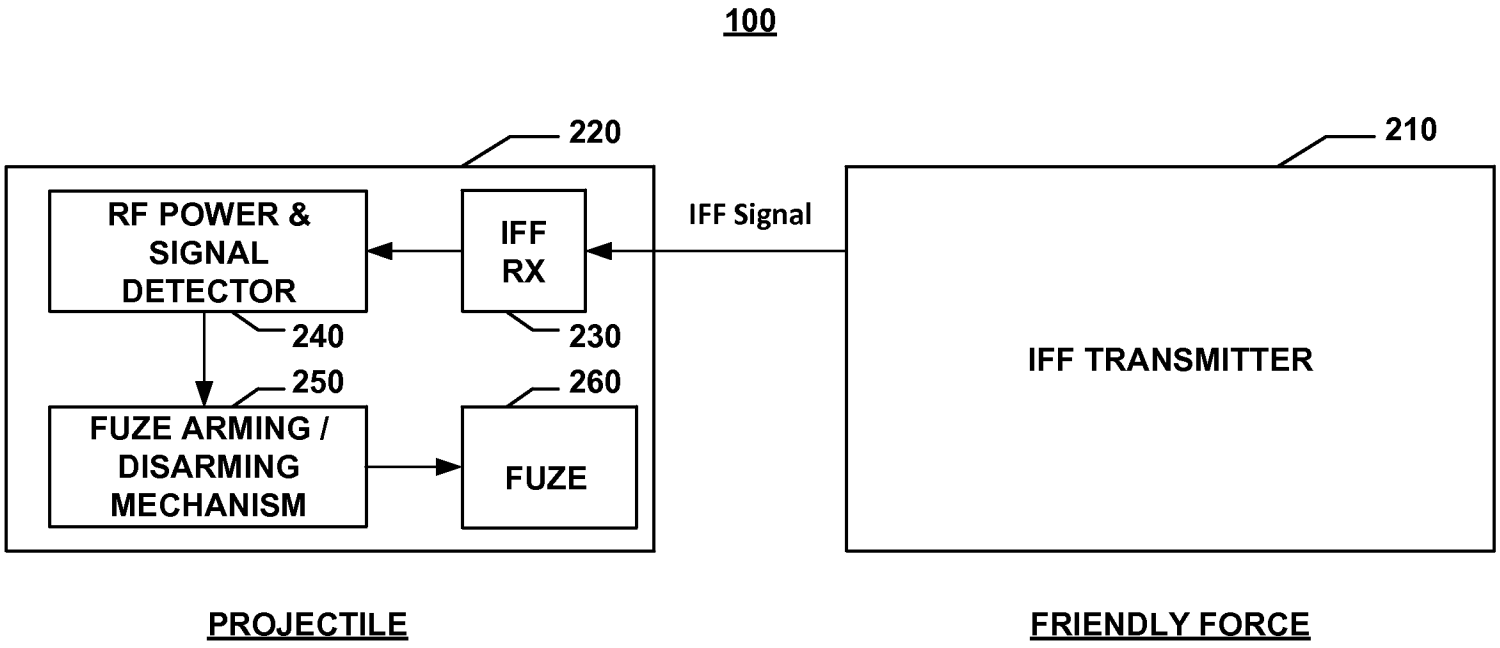
FIG. 2 is block diagram of the anti-fratricide responsive ordnance system of the present invention.

Having described the general function of the present anti-fratricide system 100, its main components will now be described in more detail, in connection with FIG. 2. The present anti-fratricide system 100 generally includes the IFF transmitter 210 that was described earlier as the field element, and an ordnance receiver 220.

Figure 3:
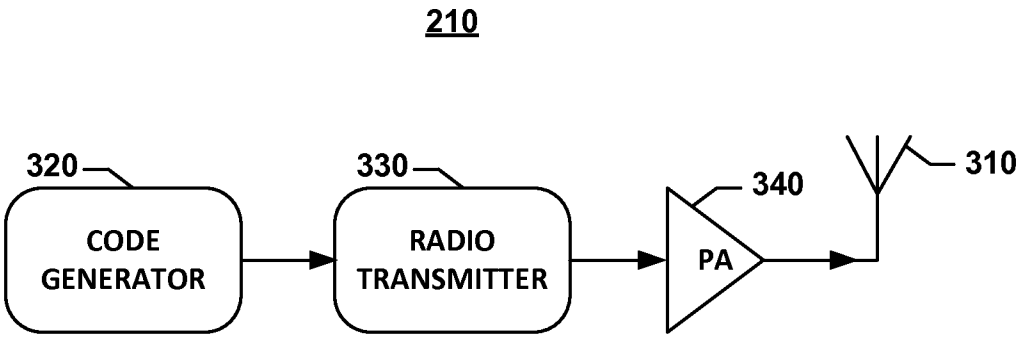
FIG. 3 is a circuit block diagram of an IFF transmitter that forms part of the anti-fratricide responsive ordnance system, and which is installed on the friendly force.

With reference to FIG. 3, the IFF transmitter 210 transmits an IFF signal that is for example similar to the signals transmitted by a Single Channel Ground Air Radio System (SINCGARS) radio or a related system. The IFF transmitter 210 generally includes a code generator 320 that encodes the IFF signal generated by a radio transmitter 330. A power amplifier (PA) 340 amplifies the encoded IFF signal, and transmits it over an antenna 310.

The following free-space path loss (FSPL) equation is used by the IFF transmitter 210 to estimate the amount of RF power needed to cover the target distance that established the strong signal zone and the weak signal zone:

$$\mathrm{FSPL(dB)}=20\log(d)+20\log(f)+20\log(4\pi/c) \quad (1).$$

where (f) refers to the operating frequency, (d) refers to distance, and (c) refers to the speed of light.

The ordnance receiver 220 will now be described in more detail in connection with FIGS. 2 and 4. The ordnance receiver 220 generally includes an antenna 410 that receives the IFF signal transmitted by the IFF transmitter 210, and that transmits the IFF signal to an IFF receiver 230.

The ordnance receiver 220 further includes an impedance matching network 420 that compensates for signal distortion introduced by an RF power and signal detector 240 of the ordnance receiver 220. Such distortion would otherwise affect the range at which the present anti-fratricide system 100 operates.

Figure 7A:
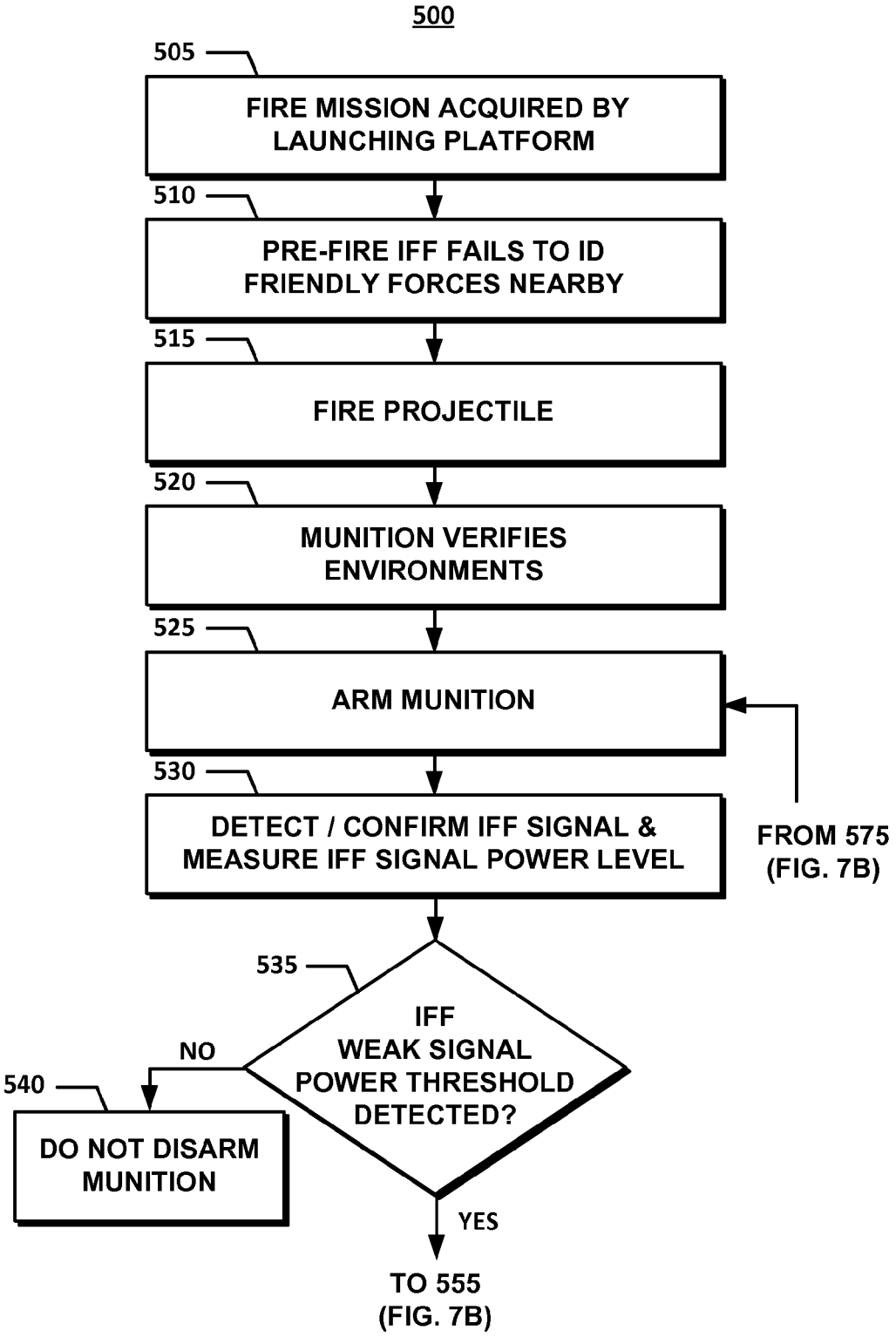
FIG. 7 is comprised of FIGS. 7A and 7B, and is a flow chart of a process of operation of the anti-fratricide responsive ordnance system of FIG. 2.
Figure 7B:
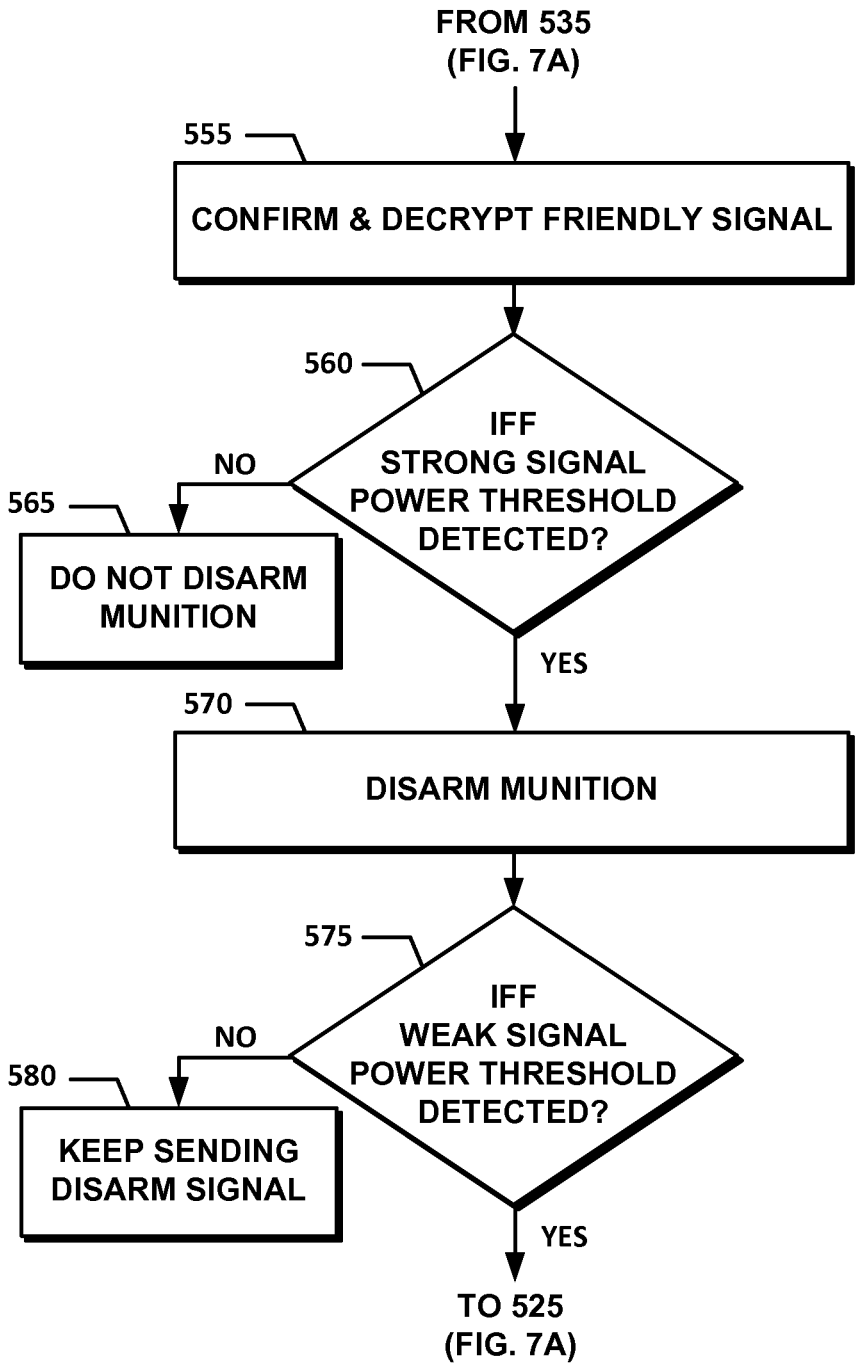

The ordnance receiver 220 also includes a fuze arming/disarming mechanism or Electronic Safe and Arm Device (ESAD) 250 that either arms or disarms a fuze 260, as it will be described later in more detail, in connection with FIG. 7.

Figure 4:
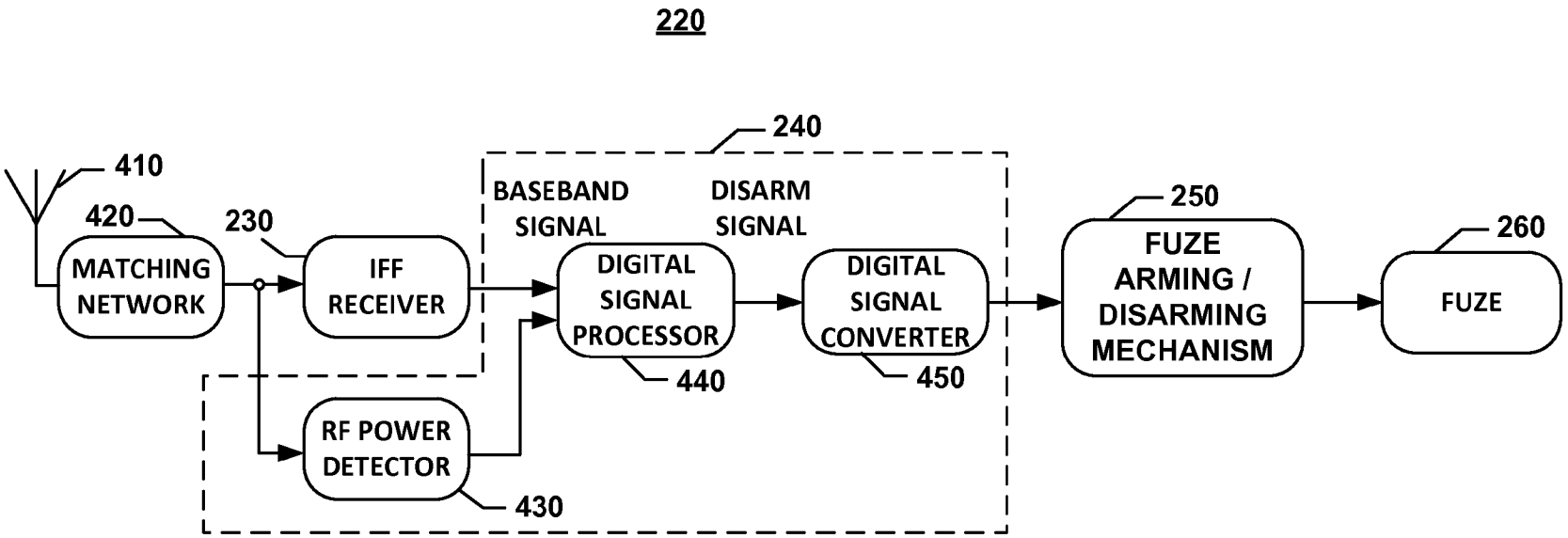
FIG. 4 is a circuit block diagram of a receiver element (or ordnance receiver) that forms part of the anti-fratricide responsive ordnance system, and which is installed on the ordnance.

With more specific reference to FIG. 4, a digital signal processor (DSP) of the RE power and signal detector 240 receives the baseband signal from the IFF receiver 230.

The digital signal processor 440 also decodes the transmitted RF code for a friendly-or-foe comparison. The digital signal processor 440 further interfaces with the fuze arming/disarming mechanism 250, via a digital signal converter 450, to control arm, disarm, and re-arm of the ordnance 20.

In general, the digital signal processor 440 embeds a software (an algorithm, an application or a computer program product) which requires that two conditions are met: The first being that the computed distance between the ordnance 20 and the friendly force 30 is within range, and the second being that the RF friendly code be identified, prior to instructing the fuze arming/disarming mechanism 250 to disarm the fuze 260. Otherwise, the digital signal processor 440 continues to instruct the fuze arming/disarming mechanism 250 to arm the fuze 260.

The digital signal processor 440 computes the distance between the ordnance 20 and the friendly force.

The fuze arming/disarming mechanism 250 (also referred to as the electronic safe and arm device or ESAD) controls the fuze 260 and the explosives on the ordnance 20. The fuze arming/disarming mechanism 250 arms the ordnance by charging a high powered detonation capacitor and then releasing that energy via a high power MOSFET into an explosive chain. A disarm command instructs the fuze arming/disarming mechanism 250 to release that energy to electrical ground instead of the explosive chain.

The interface between the fuze arming/disarming mechanism 250 and the digital signal processor 440 can be, for example, RS422 signals and Universal Asynchronous Receiver/Transmitter (UART) protocol.

The process of operation 500 of the present anti-fratricide system 100 will now be described in connection with FIGS. 1, 5, 6, and 7. At step 505 of the process 500, the launch platform 10 receives a fire mission.

At step 510, the launching platform 10 failing to identify friendly forces in the vicinity, fires the ordnance 20 at step 515.

At step 520, while the ordnance 20 is still in flight, it continues to verify its surrounding environments for IFF signals. If the ordnance 20 does not detect an IFF signal, it arms the fuze 260 at step 525.

If, however, the ordnance 20 detects and confirms an IFF signal at 530, the digital signal processor 440 (or the RF power detector 430) onboard the ordnance 20, measures the signal power level, at step 530, in order to calculate the distance of the ordnance 20 from the friendly force 30.

At decision step 535, the digital signal processor 440 determines if the measured IFF signal power level has exceeded a predetermined weak signal power threshold. If it has not, then the digital signal processor 440 determines that the ordnance 20 does not pose an imminent danger to the friendly force 30, and consequently it does not disarm the fuze 260 (step 540).

Otherwise, if at step 535, the digital signal processor 440 determines that the measured IFF signal power level has exceeded the predetermined weak signal power threshold, then it proceeds to step 555 where it confirms and decrypts the IFF signal, and sets an alert condition in preparation for disarming the ordnance 20.

The digital signal processor 440 then proceeds to decision step 560 where it inquires if the measured IFF signal power level has also exceeded a predetermined strong signal power threshold. If it has not, then the digital signal processor 440 still determines that the ordnance 20 does not pose an imminent danger to the friendly force 30, and consequently, it does not disarm the fuze 260 (step 540), but maintains the alert condition (step 565).

Figure 5:
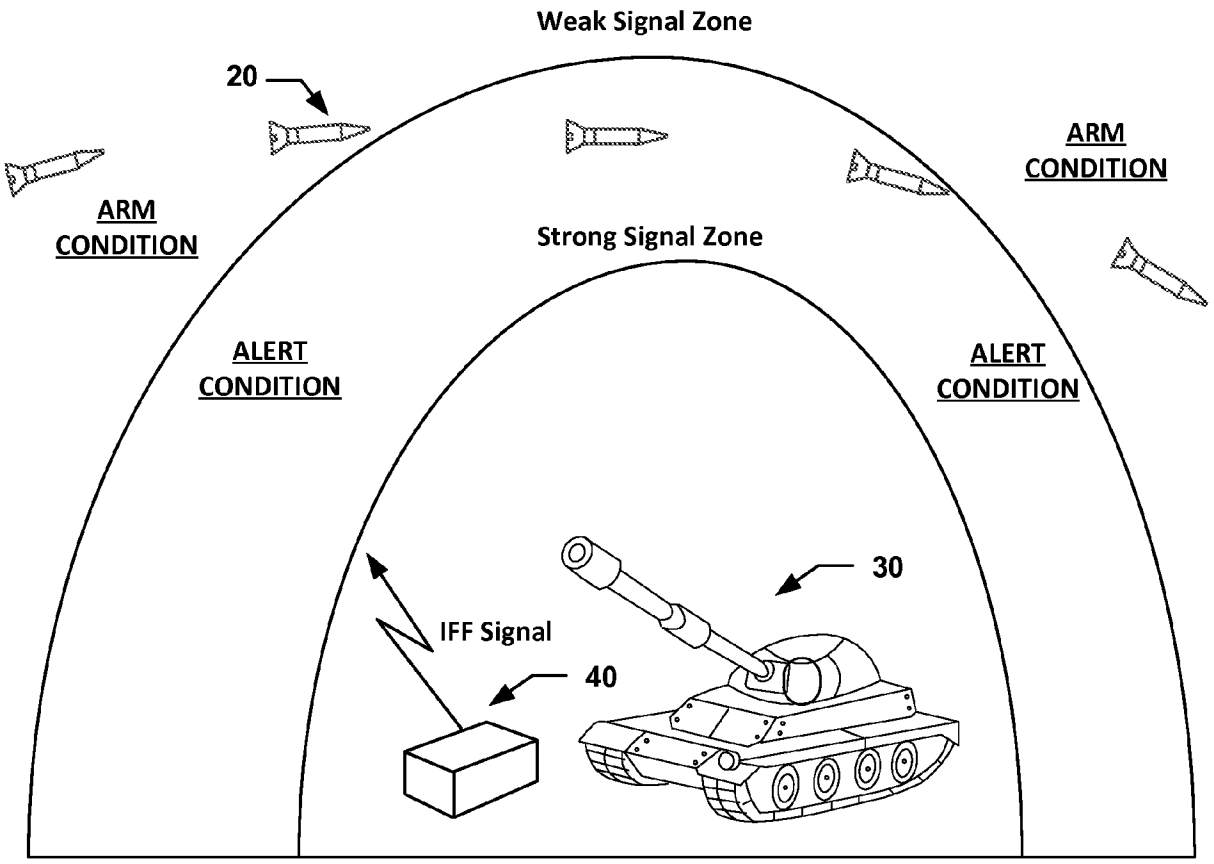
FIG. 5 is another exemplary potential fratricide scenario that is addressed by the anti-fratricide responsive ordnance system of the present invention, showing the ordnance entering the weak signal zone established by the present anti-fratricide system of FIG. 2, and then exiting the weak signal zone.

With more specific reference to FIG. 5, the ordnance 20 has entered the weak IFF signal zone, but has not entered the strong IFF signal zone, and then continues its flight to exit the weak IFF signal zone. In this scenario, the digital signal processor 440 does not disarm the fuze 260, and further removes the alert condition upon the ordnance 20 exiting the weak IFF signal zone.

If however, at step 560, the digital signal processor 440 determines that the measured IFF signal power level has exceeded the predetermined strong signal power threshold, then it proceeds to step 570 where it disarms the fuze 260. This scenario is illustrated in FIGS. 1 and 6.

The digital signal processor 440 then proceeds to decision step 575 where it determines if the weak signal power threshold is detected again. If it has not, then the digital signal processor 440 maintains the disarm condition at step 580, as illustrated in FIG. 1.

If the digital signal processor 440 determines at decision step 575 that the weak signal power threshold has been detected again, then the digital signal processor 440 proceeds to step 525, where it determines that the ordnance 20 has exited the weak IFF signal zone, and thus does not pose an imminent threat to the friendly force 30. Consequently, the digital signal processor 440 rearms the fuze 260, as illustrated in FIG. 6.

Figure 6:
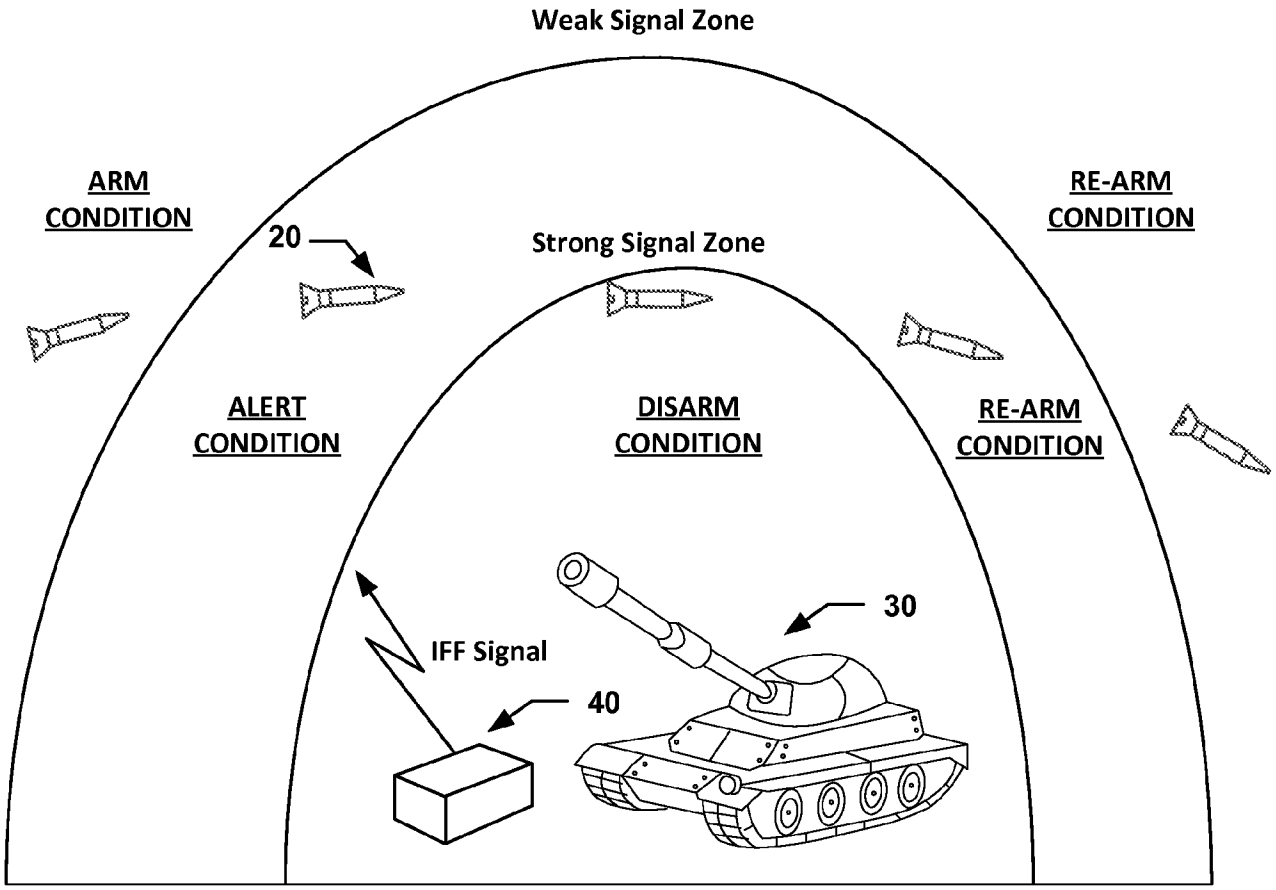
FIG. 6 is yet another exemplary potential fratricide scenario that is addressed by the anti-fratricide responsive ordnance system of the present invention, showing the ordnance successively entering the weak signal zone and then the strong signal zone that are established by the present anti-fratricide system of FIG. 2, and then exiting both the strong signal zone and the weak signal zone.

While the IFF signal is shown in FIG. 1 as being transmitted by the friendly force 30, the IFF signal is shown as being transmitted by an independent IFF unit 40 in FIG. 6. Otherwise, the operation 500 of the present anti-fratricide system 100 is identical to that described earlier in connection with FIG. 7.

It should be understood that other modifications may be made to the present design without departing from the spirit and scope of the invention.

What is claimed is:

1. A post-fire, non-interrogation-based anti-fratricide responsive ordnance system to protect a friendly force from an approaching ordnance by disarming the approaching ordnance upon entering a kill radius of the friendly force, and by re-arming the ordnance upon exiting the kill radius, the system comprising:

a transmitter that emits a friendly force signal that progressively weakens;

wherein the transmitter is located in proximity to the friendly force;

wherein the transmitter defines two zones:

a strong friendly force signal zone as a zone between the transmitter and a distance outlined by a strong friendly force threshold; and a weak friendly force signal zone as a zone outlined between the strong friendly force threshold and a weak friendly force threshold;

an ordnance receiver mounted onboard the ordnance;

wherein the ordnance receiver includes:

a receiver element that receives the transmitted friendly force signal;

a power and signal detector that recognizes the received friendly force signal and that further determines a power level of the friendly force signal in comparison to the strong friendly force threshold and the weak friendly force threshold;

upon determining that the power level of the friendly force signal has exceeded the strong friendly force threshold, the power and signal detector transmitting a disarm command signal to a safe and disarm mechanism; and in response to the disarm command signal, the safe and disarm mechanism disarms a fuze that prevents the detonation of the ordnance.

2. The system according to claim 1, wherein upon determination by the power and signal detector that the power level of the friendly force signal has exceeded the weak friendly force threshold but not the strong friendly force threshold, the power and signal detector keeps transmitting an arm command signal to the safe and disarm mechanism so as not to disarm the fuze and not to prevent the detonation of the ordnance.

3. The system according to claim 2, wherein upon determination by the power and signal detector that the power level of the friendly force signal does not exceed the weak friendly force threshold, the power and signal detector keeps transmitting an arm command signal to the safe and disarm mechanism so as not to disarm the fuze and not to prevent the detonation of the ordnance.

4. The system according to claim 1, wherein upon determination by the power and signal detector that the power level of the friendly force signal has diminished below the strong friendly force threshold but not below the weak friendly force threshold, the power and signal defector keeps transmitting an arm command signal to the safe and disarm mechanism so as not to disarm the fuze and not to prevent the detonation of the ordnance.

5. The system according to claim 1, wherein upon determination by the power and signal detector that the power level of the friendly force signal has diminished below the weak friendly force threshold, the power and signal detector transmits a re-arm command signal to the safe and disarm mechanism in order to re-arm the fuze and to reactivate the detonation of the ordnance.

6. The system according to claim 1, wherein the power and signal detector includes a power detector that determines the power level of the received friendly signal.

7. The system according to claim 6, wherein the power and signal detector further includes a digital signal processor that issues arm commands, disarm commands, and rearm commands based on the power level of the received friendly signal determined by the power and signal detector.

8. The system according to claim 1, wherein the friendly force includes a ground combat vehicle.

9. The system according to claim 1, wherein the friendly force includes at least one soldier.

10. The system according to claim 1, wherein the friendly signal includes a radio frequency signal.

11. The system according to claim 1, wherein the friendly signal includes an electromagnetic signal.

* * * * *